US007347217B2

(12) United States Patent
Bree et al.

(10) Patent No.: US 7,347,217 B2
(45) Date of Patent: Mar. 25, 2008

(54) SUNSHADE

(75) Inventors: Joan Mary Bree, 55 Wainsfort Manor Drive, Terenure, Dublin (IE) 6W; Martin Bruggemann, Dublin (IE)

(73) Assignee: Joan Mary Bree, Dublin (IE)

( * ) Notice: Subject to any disclaimer, the term of this patent is extended or adjusted under 35 U.S.C. 154(b) by 226 days.

(21) Appl. No.: 10/942,800

(22) Filed: Sep. 17, 2004

(65) Prior Publication Data

US 2005/0056309 A1 Mar. 17, 2005

(30) Foreign Application Priority Data

Sep. 17, 2003 (IE) ..... 2003/0681

(51) Int. Cl.
*E04H 15/48* (2006.01)
*E04H 15/58* (2006.01)

(52) U.S. Cl. ..... 135/149; 135/117; 135/143; 135/146; 135/153

(58) Field of Classification Search ..... 135/143, 135/146, 149, 153, 120.3, 117
See application file for complete search history.

(56) References Cited

U.S. PATENT DOCUMENTS 2,070,484 A * 2/1937 Jones ..... 135/151
2,109,881 A * 3/1938 Goldberg ..... 5/418
2,290,786 A * 7/1942 Varady ..... 5/418
2,543,597 A * 2/1951 Peery ..... 135/95
2,584,432 A 2/1952 De Marco ..... 135/7
2,771,125 A * 11/1956 Dobbins ..... 297/184.15
2,819,776 A 1/1958 Balsam ..... 190/42
2,932,833 A * 4/1960 Wambach ..... 5/656
3,241,160 A * 3/1966 Escobar ..... 5/418
3,298,477 A 1/1967 Martinez ..... 190/1
3,404,915 A * 10/1968 De Souza Filho ..... 297/17
3,651,847 A 3/1972 Casamassima ..... 150/28
4,470,630 A * 9/1984 Shields ..... 297/118
4,639,958 A 2/1987 Lerner ..... 5/418
4,739,784 A * 4/1988 Fast ..... 135/117
4,796,734 A * 1/1989 Distasio ..... 190/1
5,320,405 A * 6/1994 Foster et al. ..... 297/184.17
5,425,567 A * 6/1995 Albecker, III ..... 297/377
5,515,564 A 5/1996 Lyons ..... 5/639
5,690,134 A 11/1997 McCauley ..... 135/133
5,823,217 A * 10/1998 Rice ..... 135/124

(Continued)

FOREIGN PATENT DOCUMENTS

EP 0478475 A1 4/1992

(Continued)

*Primary Examiner*—David Dunn
*Assistant Examiner*—Tania Abraham
(74) *Attorney, Agent, or Firm*—Jacobson Holman PLLC

(57) ABSTRACT

A sunshade including a shade, a headrest, an anchoring loop, and a support frame. The support frame supports the shade and the headrest. The support frame is adjustable to enable the positions of the shade and the headrest to be set to any one of a range of in-use positions with the shade shading the headrest as required. The anchoring loop is attached to the support frame at both ends and is weighted, for example, by being filled with a weighting material, such as sand, which is inserted into the loop through an opening which is sealed during use to prevent escape of the weighting material. The anchoring loop also serves as a handle for carrying the sunshade when it is folded for transport.

41 Claims, 12 Drawing Sheets

U.S. PATENT DOCUMENTS 6,383,085 B1 * 5/2002 Tseng ..... 472/118

FOREIGN PATENT DOCUMENTS

| | | | |
|---|---|---|---|
| FR | 2400873 | | 3/1979 |
| FR | 2713265 | | 6/1995 |
| GB | 348821 | | 5/1931 |
| IE | 20020277 | A2 | 10/2002 |
| WO | WO02/082941 | | 10/2002 |

* cited by examiner

SUNSHADE

INTRODUCTION

The invention relates to a sunshade and in particular to a portable sunshade for use on the beach or the like.

Various sunshades are known. However, these are either generally large, unwieldy, difficult to use and/or ineffective in use, or smaller cheaper shades which are ineffective and easily damaged. Often sunshades are not suitable for use in windy conditions. Different types of sunshades are required for use on a beach and for use with a sun lounger. If a sunshade is to be connected to a sun lounger then additional components are needed, for example clips or fasteners. It may also be necessary to make some adjustment to the sun lounger to enable the sunshade to be received in place.

There is therefore a need for an improved sunshade which will overcome at least some of these problems.

STATEMENTS OF INVENTION

According to the invention there is provided a portable sunshade apparatus comprising a shade and a headrest and an anchoring means for anchoring the sunshade in an in-use position.

In one embodiment of the invention the anchoring means is weighted. Preferably the anchoring means comprises a hollow element having an inlet suitable for receiving a weighting material. Ideally the weighting material is sand or the like. The anchoring means may be in the form of a loop attached to the sunshade apparatus. In one case the anchoring means is configured as a carrying handle.

In another embodiment the sunshade comprises a support frame for the shade. Preferably the support frame has adjustment means to facilitate adjustment of the shade, in use. Ideally the adjustment means is self locking. The adjustment means may include a releasable locking element. Most preferably the adjustment means is a ratchet system.

In a preferred embodiment the support frame comprises:

a first frame member having an aperture therethrough, and a second frame member having a cavity therein; and a coupling pin insertable through the aperture in the first frame member and into the cavity in the second frame member to couple the first frame member to the second frame member.

Preferably the support frame comprises a retainer to retain the coupling pin inserted through the aperture in the first frame member and into the cavity in the second frame member. Ideally the retainer is engagable with a part of the coupling pin in the cavity to retain the coupling pin. The retainer may comprise at least one engagement formation for engagement with at least one co-operating engagement formation on the part of the coupling pin. Most preferably the retainer is insertable into the cavity to engage the part of the coupling pin. The support frame may comprise a retainer guide to guide insertion of the retainer into the cavity. Preferably the retainer guide comprises at least one guide formation on the retainer for co-operating with at least one guide formation in the cavity. Ideally the retainer guide formation comprises a recess part and the cavity guide formation comprises a protruding part.

The support frame may comprise a pin guide to guide insertion of the coupling pin into the cavity. Preferably the pin guide comprises at least one guide formation on the coupling pin for co-operating with at least one guide formation in the cavity. Ideally the coupling pin guide formation comprises a protruding part and the cavity guide formation comprises a recess part.

The first frame member is preferably couplable to the second frame member in one of a plurality of discrete positions. Ideally the first frame member and the second frame member comprise co-operating ratchet formations.

In one case the support frame comprises an urging member to urge the first frame member and the second frame member apart. The urging member preferably comprises a coiled spring between the first frame member and the second frame member.

The anchor may be adapted for supporting the sunshade on a substantially flat surface, such as a beach. The anchor may be adapted for supporting the sunshade on a support such as a sun lounger or the like.

In another aspect the invention provides a shade, a headrest mounted on a support frame, wherein the support frame is adjustable between a range of open configuration when the shade is positioned at a separation from the headrest, and a closed configuration when the support frame is folded so that the shade is in proximity to the headrest.

The invention also provides in a further aspect a portable sunshade apparatus comprising:— a shade;

a support frame for the shade;

the support frame comprising:

a first frame member having an aperture therethrough, and a second frame member having a cavity therein; and a coupling pin insertable through the aperture in the first frame member and into the cavity in the second frame member to couple the first frame member to the second frame member.

In one case the support frame comprises a retainer to retain the coupling pin inserted through the aperture in the first frame member and into the cavity in the second frame member. Preferably the retainer is engagable with a part of the coupling pin in the cavity to retain the coupling pin. Ideally the retainer comprises at least one engagement formation for engagement with at least one co-operating engagement formation on the part of the coupling pin The retainer is preferably insertable into the cavity to engage the part of the coupling pin. The support frame may comprise a retainer guide to guide insertion of the retainer into the cavity. Preferably the retainer guide comprises at least one guide formation on the retainer for co-operating with at least one guide formation in the cavity. Ideally the retainer guide formation comprises a recess part and the cavity guide formation comprises a protruding part.

The support frame may comprise a pin guide to guide insertion of the coupling pin into the cavity. Preferably the pin guide comprises at least one guide formation on the coupling pin for co-operating with at least one guide formation in the cavity. Ideally the coupling pin guide formation comprises a protruding part and the cavity guide formation comprises a recess part.

In one embodiment the first frame member is couplable to the second frame member in one of a plurality of discrete positions. The first frame member and the second frame member may comprise co-operating ratchet formations.

In a preferred embodiment the support frame comprises an urging member to urge the first frame member and the second frame member apart. Ideally the urging member comprises a coiled spring between the first frame member and the second frame member.

The support frame may be formed by injection moulding.

The support frame preferably has a lightweight form.

BRIEF DESCRIPTION OF THE DRAWINGS

The invention will be more clearly understood from the following description thereof given by way of example only in which:—

FIG. 4(*f*) is a view from the side of the sunshade in a closed configuration for transport;

DETAILED DESCRIPTION

Figure 1:
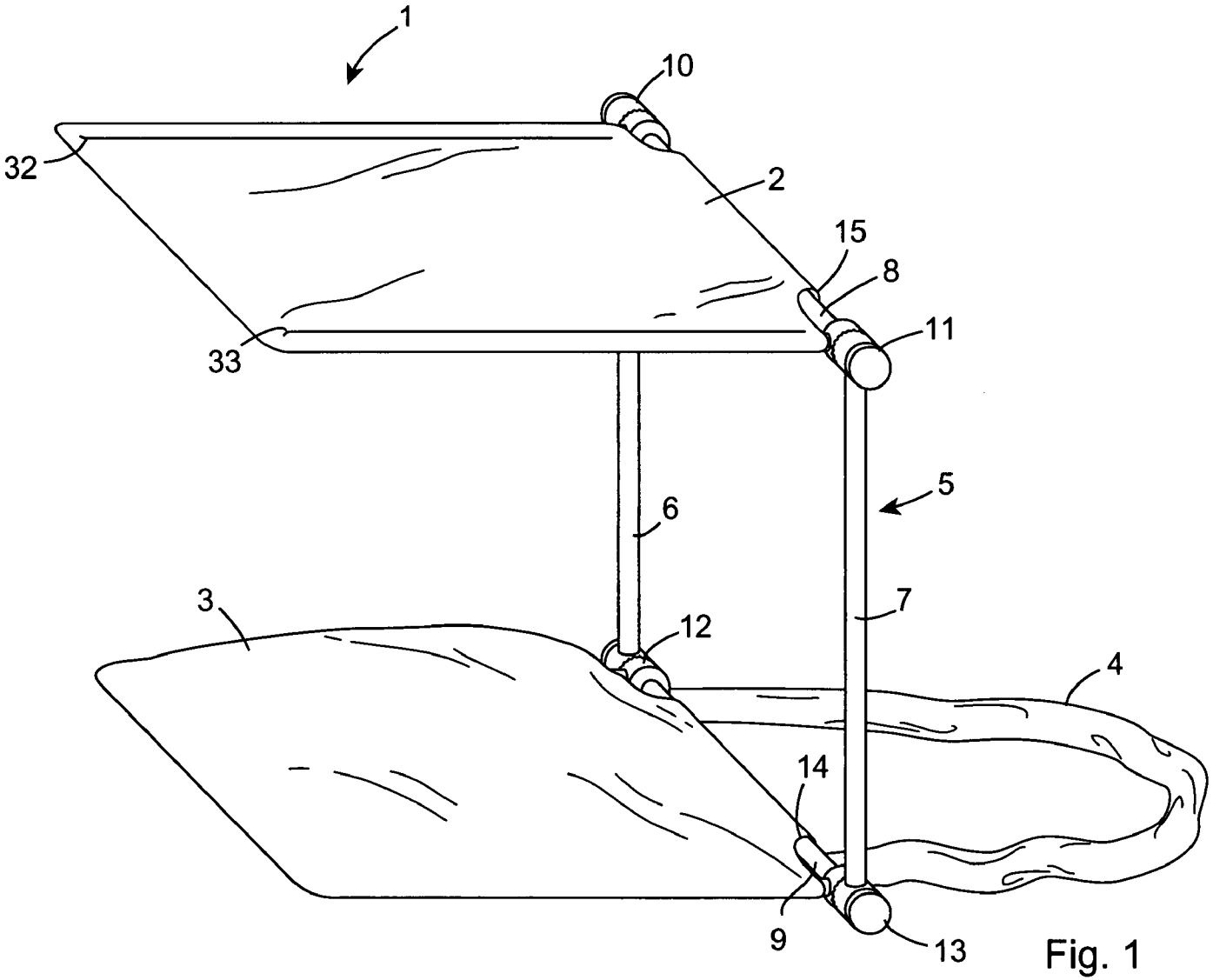
FIG. 1 is a perspective view of a sunshade according to the invention.
Figure 2:
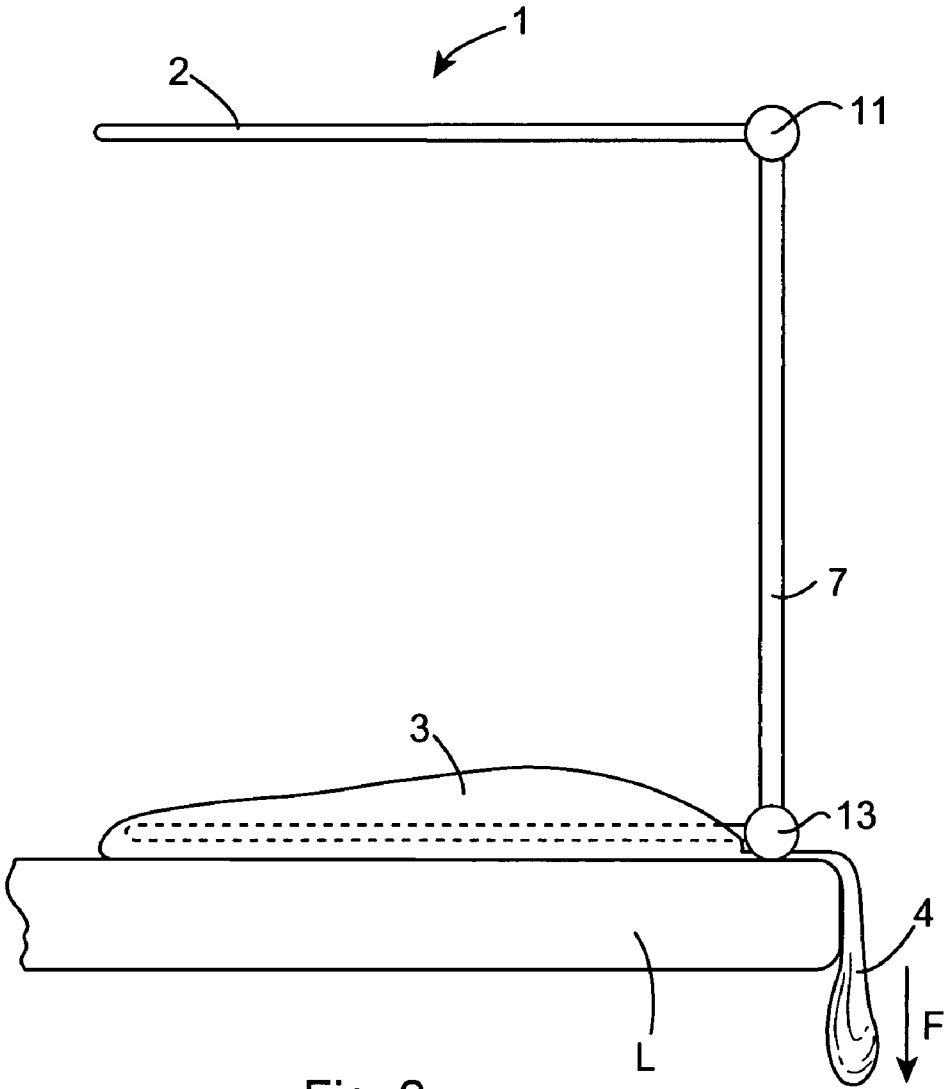
FIG. 2 is a side view of the sunshade in use on a reclined sun lounger.
Figure 3:
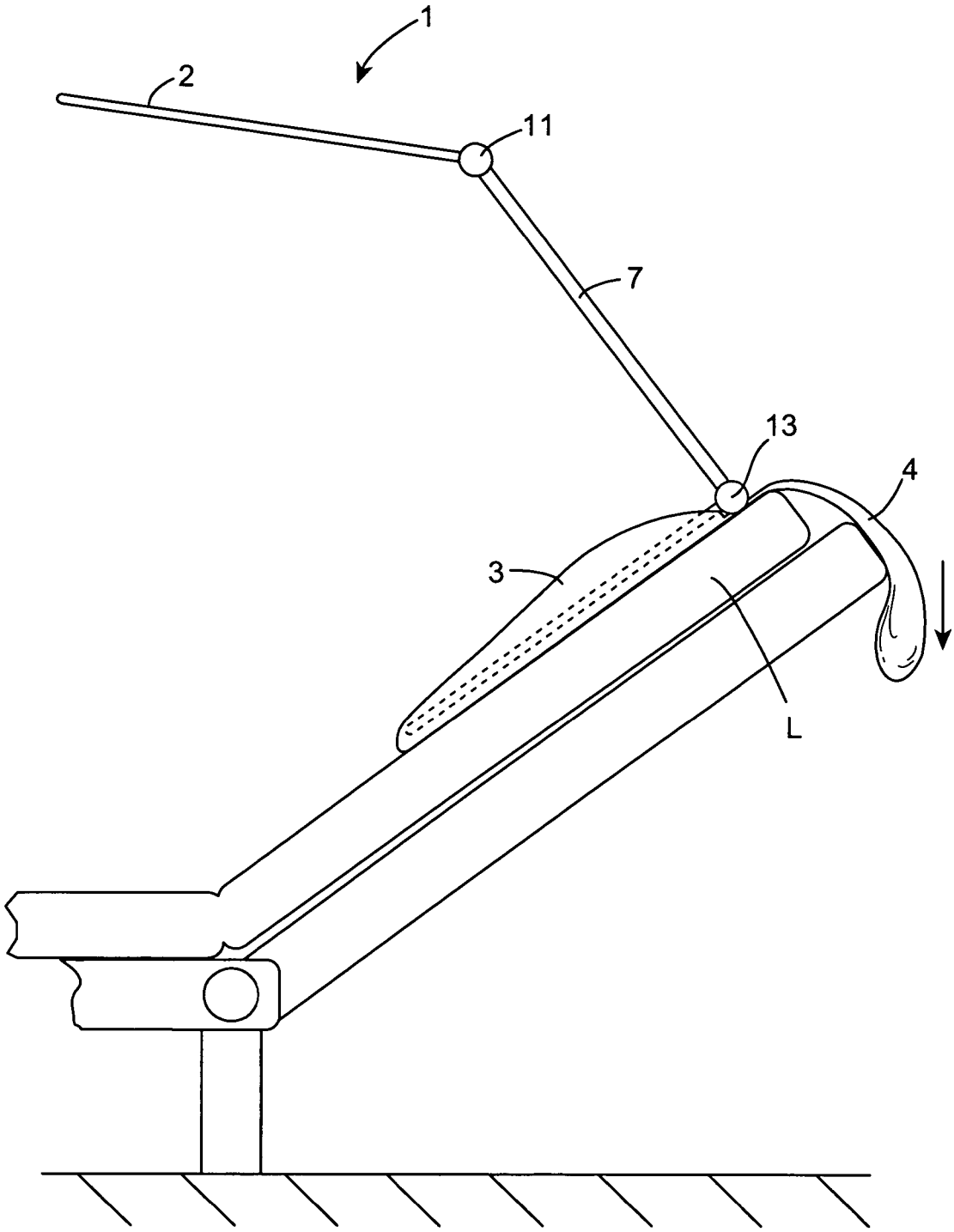
FIG. 3 is a side view of the sunshade in use on a sun lounger at an angle to the upright.

Referring to FIGS. 1 to 3, a sunshade 1 comprises a shade 2, a headrest 3, an anchoring loop 4, and a support frame 5. The support frame 5 supports the shade 2 and headrest 3, and is adjustable. The anchoring loop 4 is attached to the support frame 5 at both ends and is weighted, for example, by being filled with a weighting material such as sand which is inserted into the loop 4 through an opening which is sealed during use to prevent escape of the weighting material. The anchoring loop 4 also serves as a handle for carrying the sunshade 1 when it is folded for transport.

The support frame 5 allows movement of the various parts of the device and the sunshade is adjustable to enable the positions of the shade 2 and headrest 3 to be set to any one of a range of in-use positions with the shade 2 shading the headrest 3 as required. The position of the shade 2 relative to the headrest 3 may be varied, for example, over the course of the day to provide continued shade at the headrest 3 as the position of the sun changes. It is also possible to adjust the orientation of the shade 2, or headrest 3, or uprights relative to each other.

The sunshade is suitable for use standalone on the beach as illustrated in FIG. 1 or in combination with a sun lounger L as illustrated in FIGS. 2 and 3. In use, the weighted anchoring loop 4 anchors the sunshade in position securely and provides stability, for example if the weather conditions are windy. The anchoring loop 4 is also used to anchor the sunshade in position on a sun-lounger L whether the sun lounger L is arranged in at an incline or horizontally.

Furthermore because the anchoring loop 4 hangs from one side of the lounger L and the headrest 3 is pressed against the lounger L by the weight of the user's head, this arrangement results in a counter-weight between the anchoring loop 4 and the headrest 3. Thus this arrangement provides for further stability to hold the sunshade 1 in position.

Figures 4A, 4B, 4C, 4D, 4E, 4F:
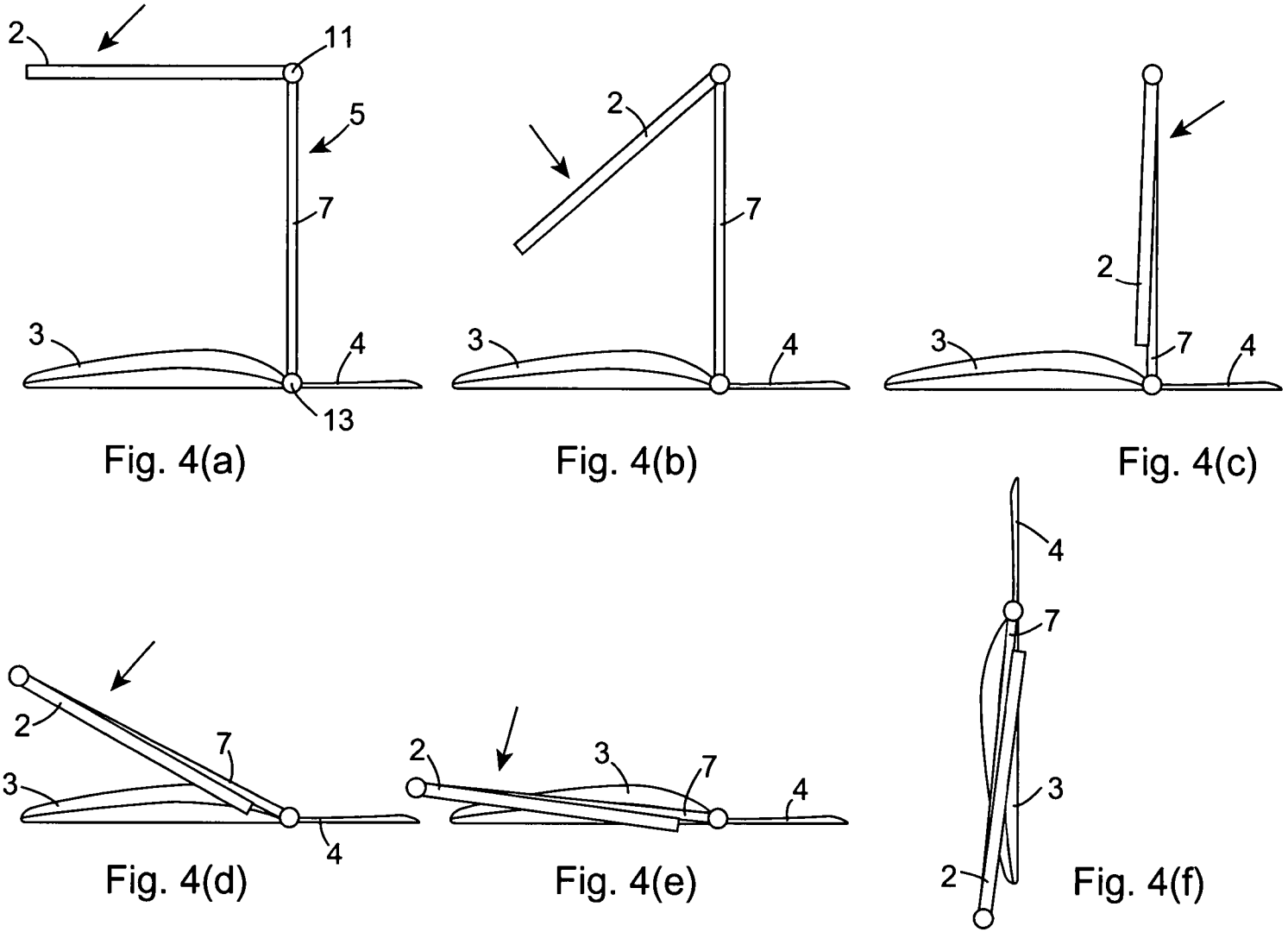
FIG. 4(*a*) is a view from the side of the sunshade in an open configuration, FIGS. 4(*b*), 4(*c*), 4(*d*) and 4(*e*) are views from the side of the steps of folding the sunshade of FIG. 4(*a*) to the closed configuration.
Figure 6B:
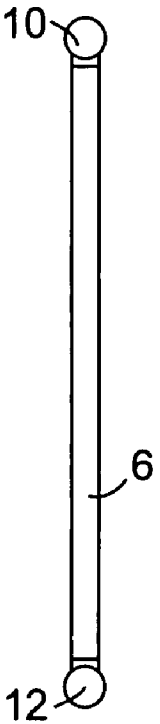
FIGS. 6(*a*) and 6(*b*) are views from the front and side of an upright support of the sunshade of FIG. 5.
Figure 6A:
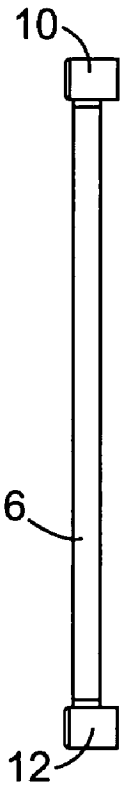
Figure 5:
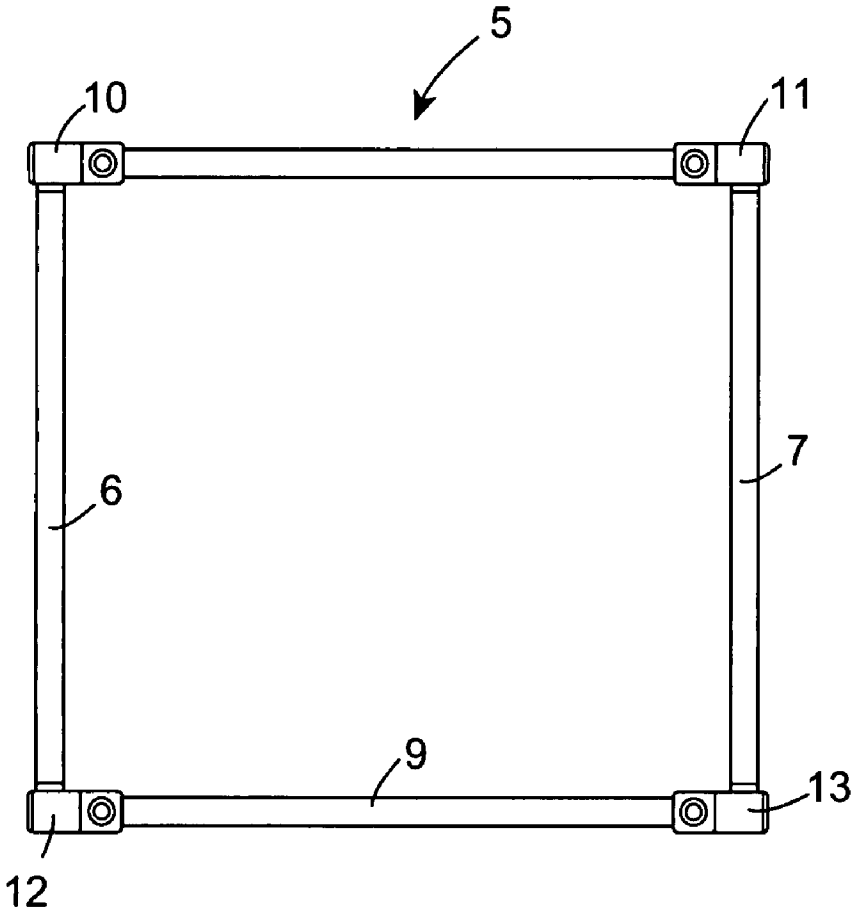
FIG. 5 is a view from the front of the frame of the sunshade.
Figure 7:
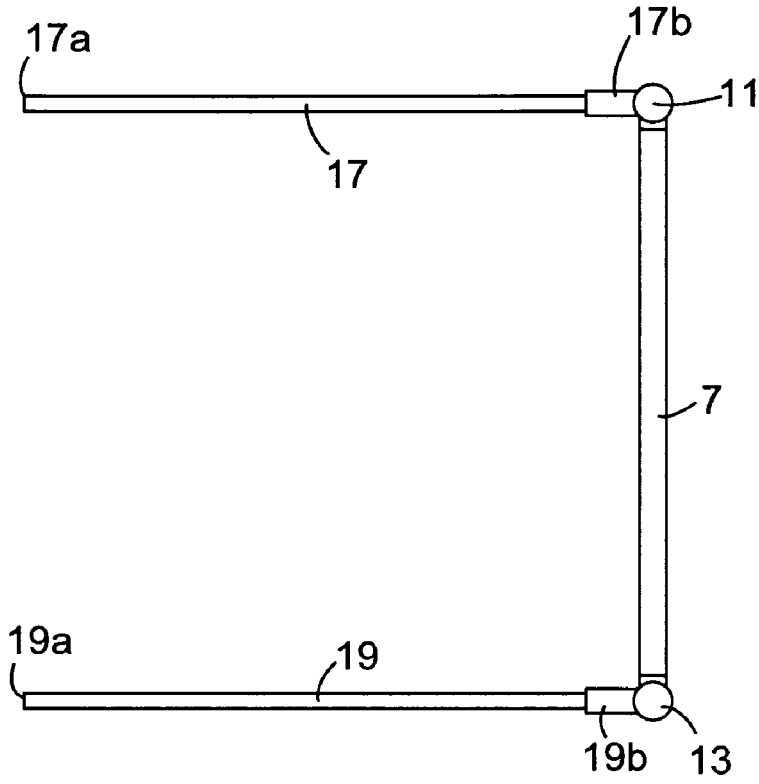
FIG. 7 is a view from the side of the frame of FIG. 5.
Figure 8:
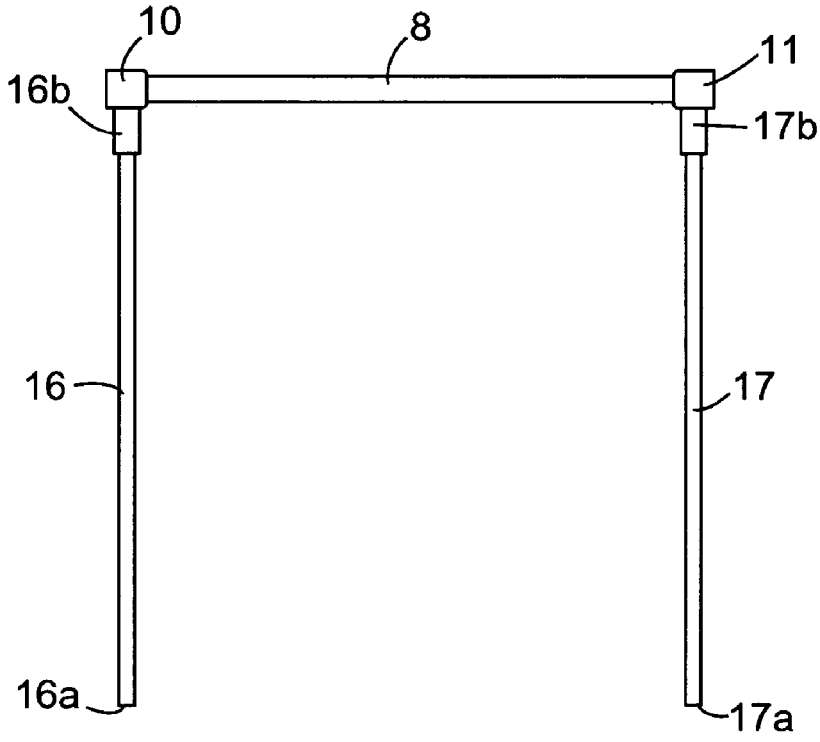
FIG. 8 is a view from above of the frame of FIG. 5.

Referring to FIGS. 4(*a*) to 4(*f*) the steps of folding a sunshade 1 from an open in-use configuration to the closed configuration for transport are illustrated. In use the anchoring loop 4 anchors the sunshade in position on a support and when folded the anchoring loop 4 also serves as a carrying handle to enable a user to transport the folded sunshade with ease. The sunshade is closed by folding the shade 2 against the upright frame supports 6, 7 and thereafter folding the shade 2 and upright frame supports against the headrest 3.

Referring to FIGS. 1 and 5 to 7 in more detail, the support frame 5 comprises a base having a pair of base side arms 18 and 19 having front free ends 18*a* and 19*a* and rear ends 18*b* and 19*b* which are received into the joints 12 and 13 respectively. A frame cross member 9 extends between the side arms 18 and 19 and is connected to the joints 12 and 13. Upright frame members 6 and 7 extend upwardly from the joints 12 and 13.

The headrest 3 comprises a cushion within a fabric cover which is supported on and in between the base side arms 18 and 19. The headrest 3 receives the base side arms 18 and 19 and is connected to the cross frame member 9 by means of wrapping an extended strip of fabric 14 around the cross frame member 9 and securing with a velcro strip, or other suitable securing means.

The shade 2 comprises a sheet of fabric material such as canvas which terminates in seams 32 and 33 in which upper side arms 16 and 17 are slidably received. The shade 2 is secured to a frame cross member 8 by wrapping an extended strip of fabric 15 around the cross frame member 8 and securing with a velcro strip or other suitable securing means. The upper side arms 16 and 17 comprise front free ends 16*a* and 17*a* and rear ends 16*b* and 17*b* which are received into joints 10 and 11 respectively. The upper cross member 8 connects joints 10 and 11. The upright frame members 6 and 7 are connected to the joints 10 and 11 respectively.

The joints 10 and 11 and 12 and 13 are adjustable to facilitate adjustment of the shade 2 in use. The joints 12 and 13 facilitate adjustment of the position of the base side arms 18 and 19 and the headrest 3 mounted therebetween relative to the upright frame members 6 and 7. The joints 10 and 11 facilitate adjustment of the position of the upper side arms 16 and 17 relative to the upright frame members 6 and 7 to allow for adjustment of the position of the shade 2 mounted therebetween relative to the upright frame members.

Figure 9:
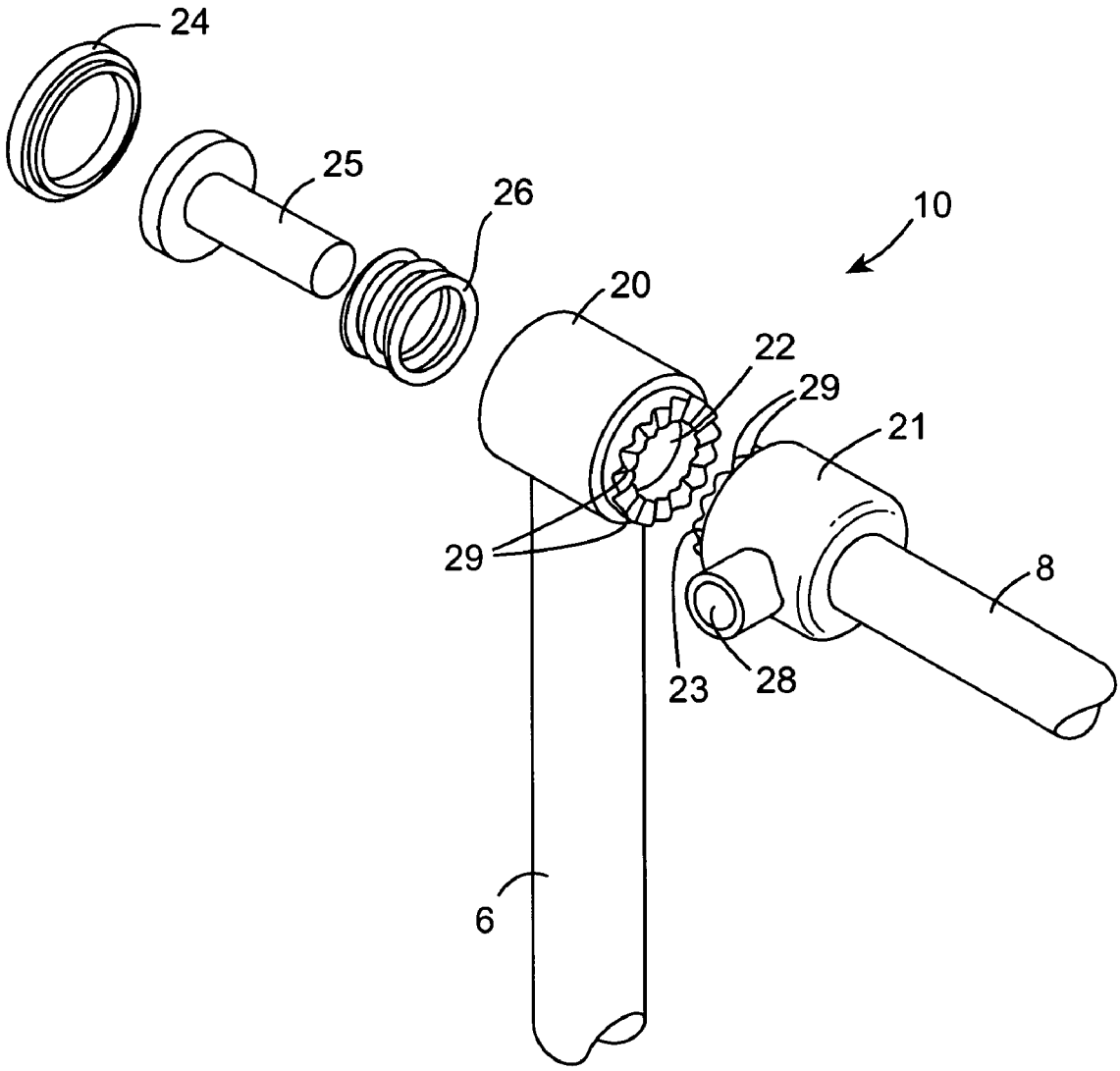
FIG. 9 is an exploded perspective view of the components of an adjustment means of a sunshade of the invention.

The joints 10, 11, 12 and 13 are similar. Referring to FIG. 9, the joint 10 is described in more detail. The joint 10 comprises two main interacting joint members an outer fixed member 20 and an inner movable member 21 mounted together on a pin 25 which passes through an aperture 22, in the fixed member 20, and is threaded into a hex-nut (not shown) housed in a recess 23 in the inner movable member 21. The pin 25 is connected through the joint members 20, 21 under the loading of a spring 26. The upright frame member 6 is integrally moulded with the fixed member 20 and the cross bar 8 is integrally moulded with the inner movable member 21. The inner movable member 21 further comprises an aperture 28 for receiving the upper side arm 16. The abutting faces of the joint members 20 and 21 comprise a plurality of teeth 29 which facilitate the locking of joint at any of a plurality of positions.

No assembly of the support frame 5 is required by the user.

Figure 10:
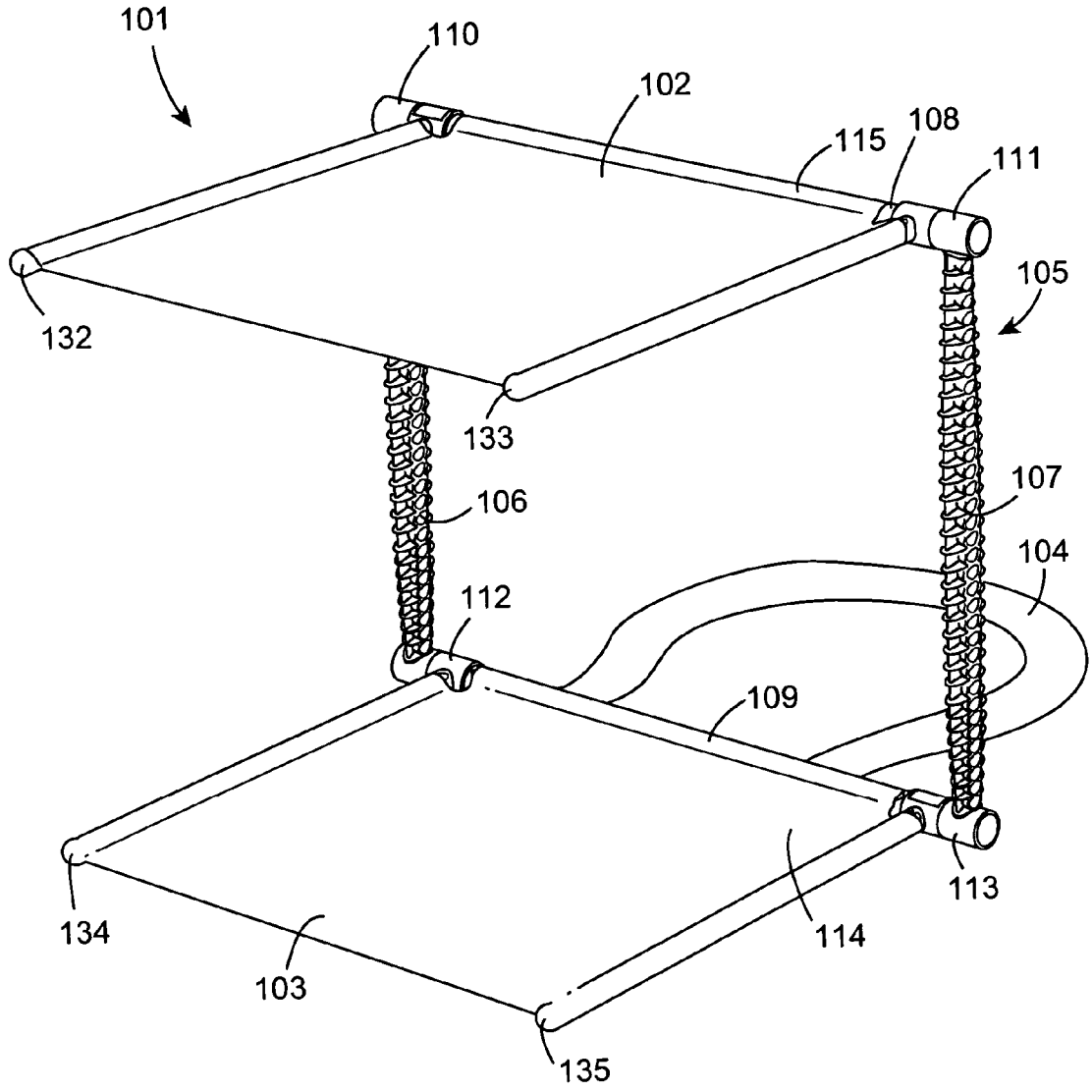
FIG. 10 is a perspective view of a sunshade according to an alternative embodiment the invention.
Figure 11:
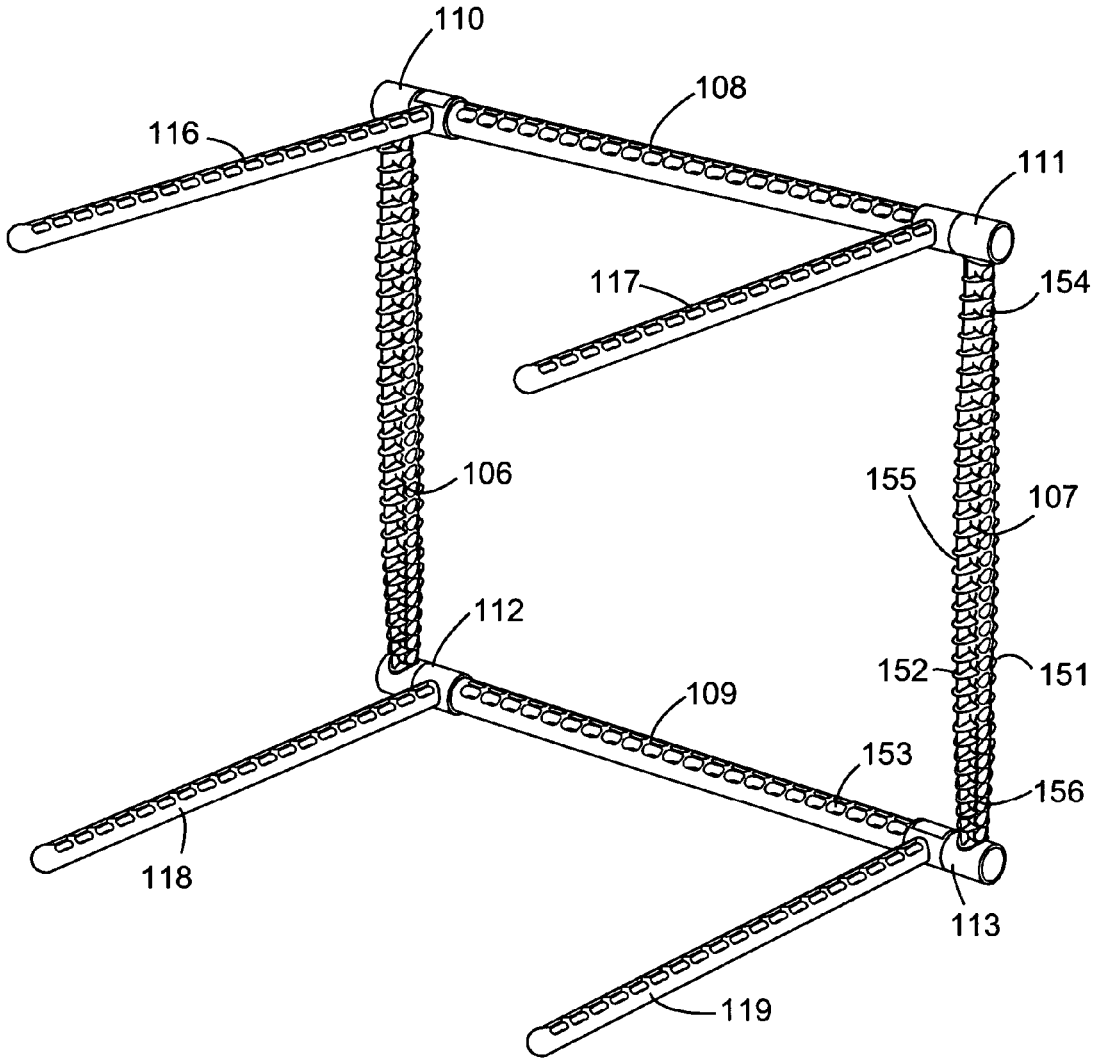
FIG. 11 is a perspective view of the frame of the sunshade of FIG. 10.

Referring to FIGS. 10 and 11 a sunshade 101 comprises a shade 102, a headrest 103, an anchoring loop 104, and a support frame 105. The sunshade 101 is similar to the sunshade 1 of FIG. 1 and similar features have been assigned similar reference numerals.

The support frame 105 comprises a base having a pair of base side arms 118 and 119 connected by a cross member 109 at joints 112 and 113, and a top having a pair of upper side arms 116 and 117 connected by a cross member 108 at joints 110 and 111. Upright frame members 106 and 107 connect the top and base at the joints.

The shade 102 comprises a sheet of fabric material such as canvas which terminates in seams 132 and 133 in which upper side arms 116 and 117 are slidably received. The headrest 103, which includes an integral cushion terminates in seams 134 and 135 in which lower side arms 118 and 119 are slidably received.

Figure 12:
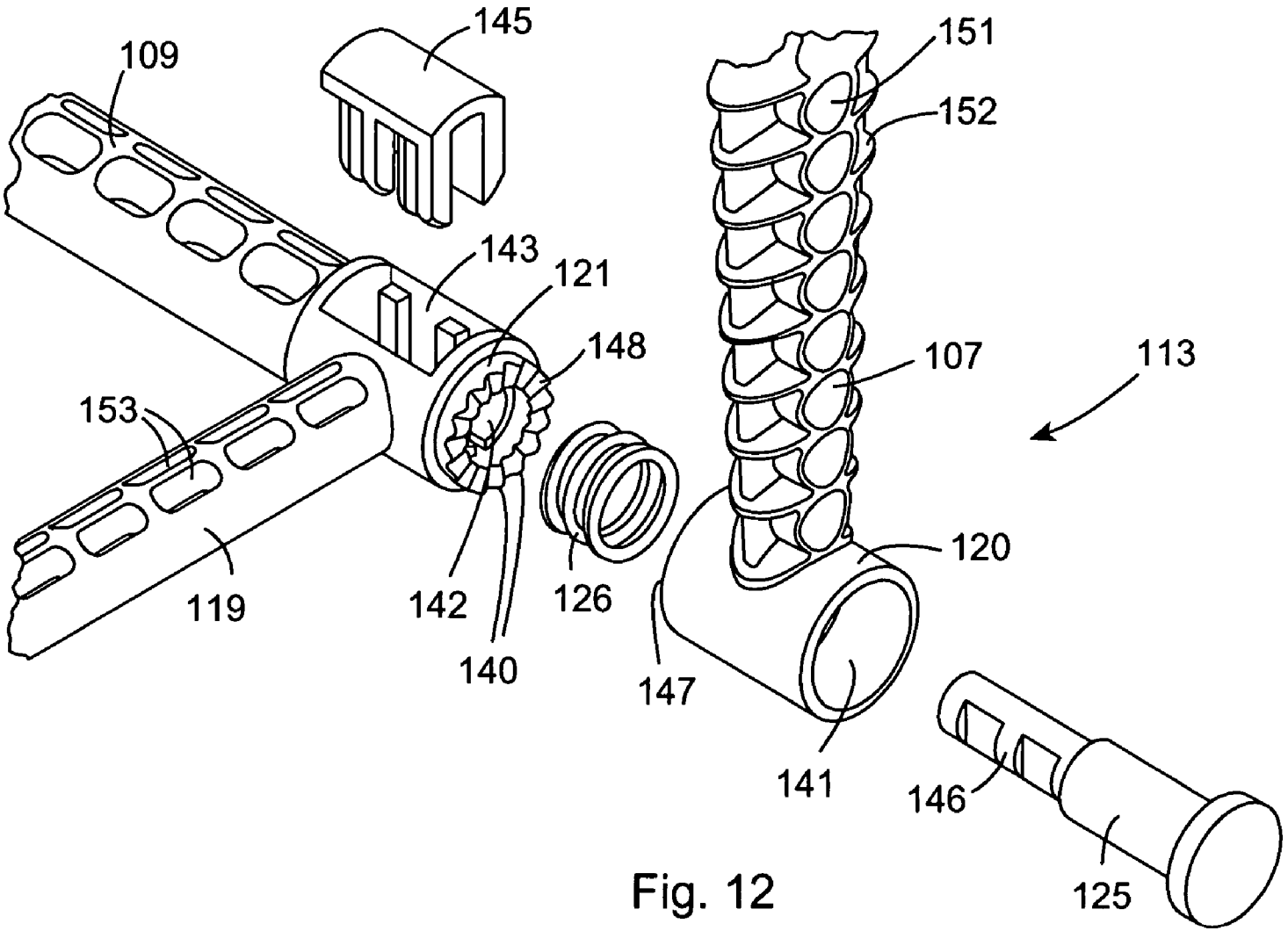
FIG. 12 is an exploded perspective view of the components of an adjustment means according to an alternative embodiment of a sunshade of the invention.

The joints 110, 111, 112 and 113 are similar. Referring to FIG. 12, the joint 113 is described in more detail. The joint 113 comprises two main interacting joint members an outer fixed member 120 and an inner movable member 121 mounted together on a pin 125 which passes through an aperture 141, in the fixed member 120, and is received in an aperture in the inner movable member 121. The pin 125 is connected to the joint members 120, 121 under the loading of a spring 126. The pin 125 is held in place in the inner joint member 121 by means of a clip member 145 which corresponds in form with the end 146 of the pin 125 to enable interconnection.

The upright frame member 107 is integrally moulded with the fixed member 120 and the cross bar 109 and arm 119 are integrally moulded with the inner movable member 121. The abutting faces 148 and 147 of the joint members 120 and 121 comprise a plurality of teeth 140 which facilitate the locking of joint at any one of a plurality of discrete positions.

The joint 113 is illustrated in further detail in FIGS. 13 to 19.

Figure 17:
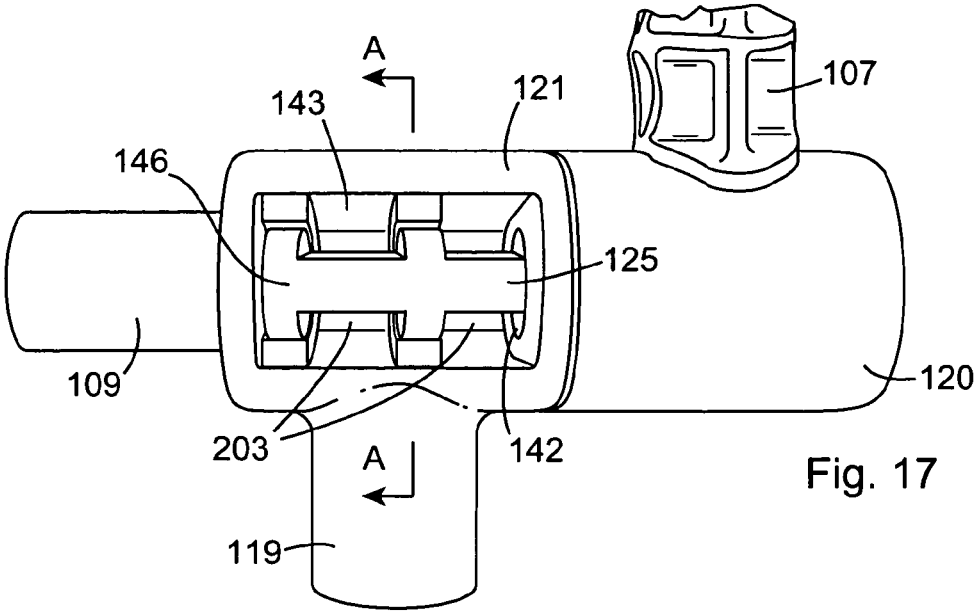
FIG. 17 is a plan view of the sunshade of FIG. 12 after assembly.

The inner movable member 121 has a cavity 143 therein and the outer fixed member 120 has an aperture 141 therethrough. To couple the outer fixed member 120 to the inner movable member 121, the coupling pin 125 is inserted through the aperture 141 and into the cavity 143. This coupling action is illustrated in FIGS. 16 and 17.

Figure 14:
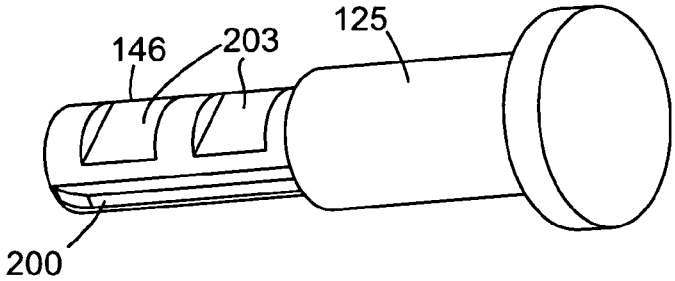
FIG. 14 is a perspective view of a pin of the sunshade of FIG. 12.
Figure 15:
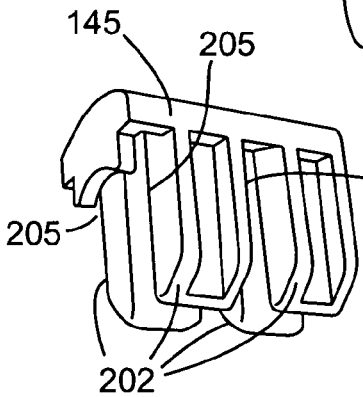
FIG. 15 is a perspective view of a clip member of the sunshade of FIG. 12.
Figure 13:
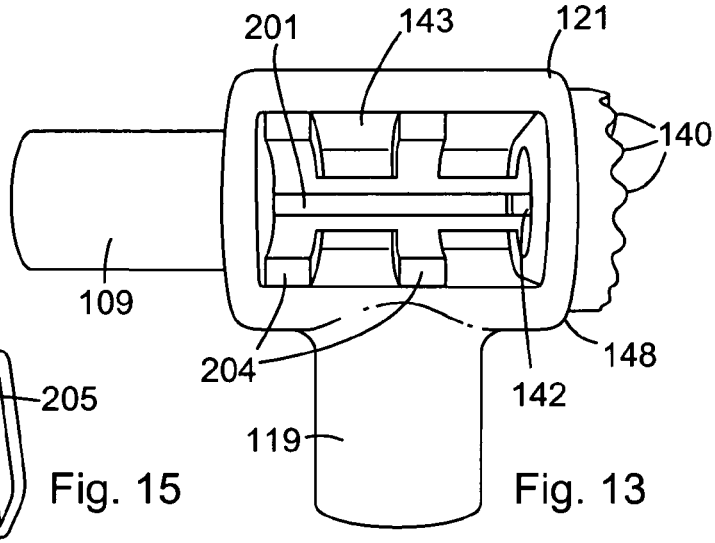
FIG. 13 is a plan view of an aperture in an inner movable member of the sunshade of FIG. 12.

A protruding spline 200 is formed on the base of the coupling pin 125 (FIG. 14). This spline 200 is mateable with a co-operating channel 201 in the base of the cavity 143 (FIGS. 13 and 16). The co-operating action of the spline 200 and channel 201 act to guide the pin 125 into the cavity 143 in a controlled manner. In particular it is only possible for a user to insert the pin 125 into the cavity 143 with the pin 125 in the upright configuration illustrated in FIG. 18.

To retain the pin 125 in position inserted through the aperture 141 and into the cavity 143, and thus to retain the outer fixed member 120 coupled to the inner movable member 121, the retainer clip member 145 is inserted into the cavity 143. Upon insertion into the cavity 143, the four protruding legs 202 of the retainer 145 engage against the four co-operating slots 203 in the clip 125. In this manner the clip 125 is held in position in the cavity 143.

Figures 16, 18, 19:
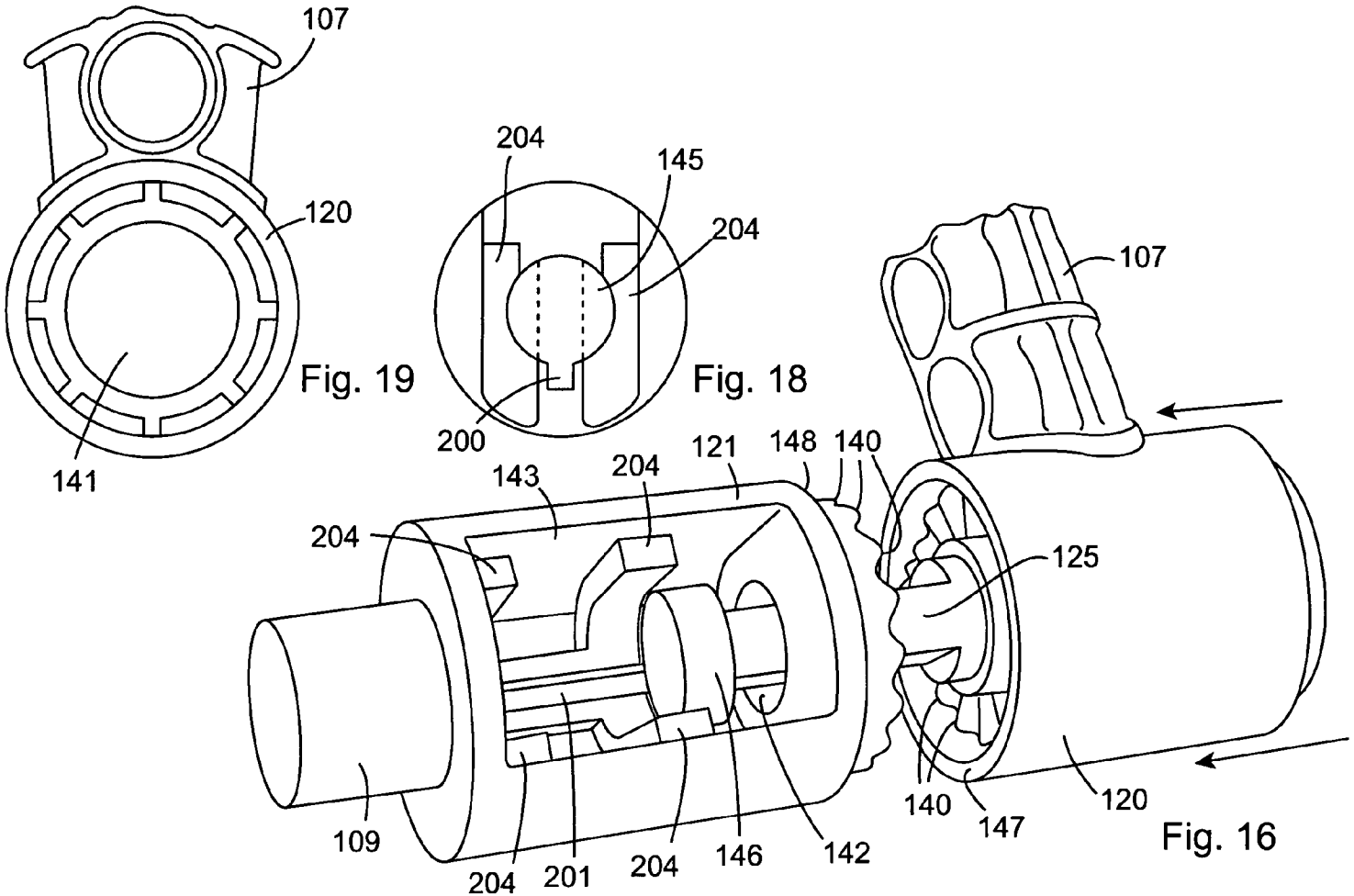
FIG. 16 is a perspective view illustrating assembly of the sunshade of FIG. 12.
FIG. 18 is a view along line A-A in FIG. 17.
FIG. 19 is an end view of an aperture in an outer fixed member of the sunshade of FIG. 12.

To guide insertion of the retainer 145 into the cavity 143, four protruding fingers 204 are provided upstanding along the inner walls of the cavity 143 (FIG. 16). These fingers 204 mate with four corresponding recess portions 205 in the retainer 145, upon insertion of the retainer 145 into the cavity 143. In this manner the retainer 145 is guided into the cavity 143 in a controlled manner.

The coiled spring 126 acts to urge the outer fixed member 120 away from the inner movable member 121. The spring 126 thus assists in urging the members 120, 121 apart for repositioning of the members 120, 121 relative to one another.

The toothed surfaces 148, 147 enable adjustment of the members 120, 121 in a ratchet action. It is not necessary to disassemble the outer fixed member 120 from the inner movable member 121 to enable adjustment. The members 120, 121 can be adjusted while coupled together.

In use, the position of a portion of the sunshade 1, for example, the shade 2 is adjusted by a user first of all exerting a force on the upper side arms 16, 17 to release the locked joints 10 and 11 and then moving the upper side arms 16 and 17 and the shade mounted thereon to the desired new position. Releasing the upper side arms 16, 17 causes the joints 10 and 11 to lock in the new position. The position of the upright frame members 6 and 7 relative to the headrest 3 and shade 2 and of the base side arms 18 and 19 relative to the upright frame members may be similarly adjusted. The sunshade 101 is adjusted in a similar manner.

The arms and upright frame members of the support frame 105 are formed by injection moulding. The support frame 105 is lightweight by virtue of the moulded forms of the arms and members which include formations and recesses 151 and 152, and apertures 153. The upright member 107 is formed such that the tops and bottom ends 154 and 156 are narrower than the middle portion 156 thereof.

The lightweight nature of the support frame 105 ensures that the sunshade is light and easy to carry.

The support frame 105 may be pre-assembled. Thus the user is not required to assemble the support frame 105.

The frame may be manufactured such that the upright, cross members, or side arms are integral with the inner or outer joint members. Alternatively the frame may be manufactured such that the components are assembled together.

The sunshade of the present invention has the advantages that it is robust without being unwieldy or awkward to handle. The sunshade is folded for transport and easily assembled from the folded configuration for use. The sunshade and headrest may be set at any of a range of positions in relation to each other. The use of four adjustable joints provides additional flexibility in setting the position of the shade relative to the headrest at it is possible to vary the angle and position both the shade and headrest relative to upright portion of the support frame. The joint allows the user to lock the sunshade in the selected position and also allows for adjustment of the position of the sunshade to any intermediate setting between the closed configuration and the maximum opened position.

In addition the shade is very easy to use since the user simply exerts a force on one of the extending arms which extend from the joint. No tools are required to adjust the joint and the user does not need to make manual adjustments at the joint.

Assembly of the support frame may be performed quickly and easily.

The guide means ensure that it is not possible to incorrectly assemble the support frame. In this manner, the support frame is fool-proof.

The shade may be adjusted while lying down, which enhances the comfort and ease of use of the sunshade.

The fabric of the shade and the headrest may be removed, for example for cleaning.

The sunshade of the invention may be used either standalone on the beach or in combination with a sun lounger. The anchor of the sunshade facilities use on a sun lounger without the need for additional components such as clip or connection means to connect the sunshade to the lounger. In addition it is not necessary to modify the lounger in any way to enable use of the sunshade. Thus the sunshade of the invention may be flexibly used with any type of sun lounger/sun chair.

The invention is not limited to the embodiments hereinbefore described which may be varied in detail.

The invention claimed is:

1. A portable sunshade apparatus comprising
a shade,
a headrest, and
an anchoring means for anchoring the sunshade in an in-use position,
the sunshade including a support frame for the shade,
the support frame including
a first frame member having an aperture therethrough, and a second frame member having a cavity therein;
a coupling pin insertable through the aperture in the first frame member and into the cavity in the second frame member to couple the first frame member to the second frame member; and
a retainer to retain the coupling pin inserted through the aperture in the first frame member and into the cavity in the second frame member, the retainer being engagable with a part of the coupling pin in the cavity to retain the coupling pin.

2. The portable sunshade apparatus as claimed in claim 1, wherein the anchoring means is weighted.

3. The portable sunshade apparatus as claimed in claim 1, wherein the anchoring means comprises a hollow element having an inlet suitable for receiving a weighting material.

4. The portable sunshade apparatus as claimed in claim 3, wherein the weighting material is sand.

5. The portable sunshade apparatus as claimed in claim 1, wherein the anchoring means is in the form of a loop attached to the sunshade apparatus.

6. The portable sunshade apparatus as claimed in claim 1, wherein the anchoring means is configured as a carrying handle.

7. The portable sunshade apparatus as claimed in claim 1, wherein the support frame has adjustment means to facilitate adjustment of the shade, in use.

8. The portable sunshade apparatus as claimed in claim 7, wherein the adjustment means is self locking.

9. The portable sunshade apparatus as claimed in claim 7 wherein the adjustment means include a releasable locking element.

10. The portable sunshade apparatus as claimed in claim 7, wherein the adjustment means is a ratchet system.

11. The portable sunshade apparatus as claimed in claim 1 wherein the retainer comprises at least one engagement formation for engagement with at least one co-operating engagement formation on the part of the coupling pin.

12. The portable sunshade apparatus as claimed in claim 1 wherein the retainer is insertable into the cavity to engage the part of the coupling pin.

13. The portable sunshade apparatus as claimed in claim 12 wherein the support frame comprises a retainer guide to guide insertion of the retainer into the cavity.

14. The portable sunshade apparatus as claimed in claim 13 wherein the retainer guide comprises at least one guide formation on the retainer for co-operating with at least one guide formation in the cavity.

15. The portable sunshade apparatus as claimed in claim 14 wherein the retainer guide formation comprises a recess part and the cavity guide formation comprises a protruding part.

16. The portable sunshade apparatus as claimed in claim 1 wherein the support frame comprises a pin guide to guide insertion of the coupling pin into the cavity.

17. The portable sunshade apparatus as claimed in claim 16 wherein the pin guide comprises at least one guide formation on the coupling pin for co-operating with at least one guide formation in the cavity.

18. The portable sunshade apparatus as claimed in claim 17 wherein the coupling pin guide formation comprises a protruding part and the cavity guide formation comprises a recess part.

19. The portable sunshade apparatus as claimed in claim 1 wherein the first frame member is couplable to the second frame member in one of a plurality of discrete positions.

20. The portable sunshade apparatus as claimed in claim 19 wherein the first frame member and the second frame member comprise co-operating ratchet formations.

21. The portable sunshade apparatus as claimed in claim 1 wherein the support frame comprises an urging member to urge the first frame member and the second frame member apart.

22. The portable sunshade apparatus as claimed in claim 21 wherein the urging member comprises a coiled spring between the first frame member and the second frame member.

23. The portable sunshade apparatus as claimed in claim 1 wherein the anchor is adapted for supporting the sunshade on a substantially flat surface.

24. The portable sunshade apparatus as claimed in claim 1 wherein the anchor is adapted for supporting the sunshade on a support.

25. A portable sunshade apparatus comprising:
a shade;
a support frame for the shade;
the support frame comprising:
a first frame member having an aperture therethrough, and a second frame member having a cavity therein;
a coupling pin insertable through the aperture in the first frame member and into the cavity in the second frame member to couple the first frame member to the second frame member; and
a retainer to retain the coupling pin inserted through the aperture in the first frame member and into the cavity in the second frame member, the retainer being engagable with a part of the coupling pin in the cavity to retain the coupling pin.

26. The portable sunshade apparatus as claimed in claim 25 wherein the retainer comprises at least one engagement formation for engagement with at least one co-operating engagement formation on the part of the coupling pin.

27. The portable sunshade apparatus as claimed in claim 25 wherein the retainer is insertable into the cavity to engage the part of the coupling pin.

28. The portable sunshade apparatus as claimed in claim 27 wherein the support frame comprises a retainer guide to guide insertion of the retainer into the cavity.

29. The portable sunshade apparatus as claimed in claim 28 wherein the retainer guide comprises at least one guide formation on the retainer for co-operating with at least one guide formation in the cavity.

30. The portable sunshade apparatus as claimed in claim 29 wherein the retainer guide formation comprises a recess part and the cavity guide formation comprises a protruding part.

31. The portable sunshade apparatus as claimed in claim 25 wherein the support frame comprises a pin guide to guide insertion of the coupling pin into the cavity.

32. The portable sunshade apparatus as claimed in claim 31 wherein the pin guide comprises at least one guide formation on the coupling pin for co-operating with at least one guide formation in the cavity.

33. The portable sunshade apparatus as claimed in claim 32 wherein the coupling pin guide formation comprises a protruding part and the cavity guide formation comprises a recess part.

34. The portable sunshade apparatus as claimed in claim 25 wherein the first frame member is couplable to the second frame member in one of a plurality of discrete positions.

35. The portable sunshade apparatus as claimed in claim 34 wherein the first frame member and the second frame member comprise co-operating ratchet formations.

36. The portable sunshade apparatus as claimed in claim 25 wherein the support frame comprises an urging member to urge the first frame member and the second frame member apart.

37. The portable sunshade apparatus as claimed in claim 36 wherein the urging member comprises a coiled spring between the first frame member and the second frame member.

38. The portable sunshade apparatus as claimed in claim 25 wherein the support frame is formed by injection moulding.

39. The portable sunshade apparatus as claimed in claim 25 wherein the support frame has a lightweight form.

40. A portable sunshade apparatus comprising a shade, a headrest, and an anchoring means for anchoring the sunshade in an in-use position, the sunshade including a support frame for the shade, the support frame includes a first frame member having an aperture therethrough, and a second frame member having a cavity therein;

a coupling pin insertable through the aperture in the first frame member and into the cavity in the second frame member to couple the first frame member to the second frame member;

a pin guide to guide insertion of the coupling pin into the cavity, the pin guide having at least one guide formation on the coupling pin for co-operating with at least one guide formation in the cavity, the coupling pin guide formation including a protruding part and the cavity guide formation having a recess part.

41. A portable sunshade apparatus comprising:

a shade;

a support frame for the shade;

the support frame including a first frame member having an aperture therethrough, and a second frame member having a cavity therein;

a coupling pin insertable through the aperture in the first frame member and into the cavity in the second frame member to couple the first frame member to the second frame member; and a pin guide to guide insertion of the coupling pin into the cavity, the pin guide including at least one guide formation on the coupling pin for co-operating with at least one guide formation in the cavity, the coupling pin guide formation including a protruding part and the cavity guide formation having a recess part.

* * * * *